United States Patent [19]

Taki

[11] 4,177,444

[45] Dec. 4, 1979

[54] TIME LAG FUSE

[75] Inventor: Minoru Taki, Yokohama, Japan

[73] Assignee: Fukada Works, Ltd., Tokyo, Japan

[21] Appl. No.: 889,505

[22] Filed: Mar. 23, 1978

[30] Foreign Application Priority Data

Aug. 8, 1977 [JP] Japan ..... 52-1051625[U]

[51] Int. Cl.[2] ..... H01H 85/04

[52] U.S. Cl. ..... 337/163; 337/290

[58] Field of Search ..... 337/163, 164, 290, 292, 337/295, 296, 297

[56] References Cited

U.S. PATENT DOCUMENTS

| | | | |
|---|---|---|---|
| 1,629,266 | 5/1927 | Feldkamp | 337/296 |
| 3,196,235 | 7/1965 | Puydak | 337/296 X |
| 3,489,977 | 1/1970 | Smith, Jr. | 337/163 X |

*Primary Examiner*—George Harris

*Attorney, Agent, or Firm*—Cushman, Darby & Cushman

[57] ABSTRACT

A time lag fuse with a fuse barrel having a conductive cap closing each open end and a fuse element within the barrel formed of twisted or bundled insulating fiber spirally bound by a melting alloy of a silver, copper or lead alloy.

5 Claims, 3 Drawing Figures

TIME LAG FUSE

BACKGROUND OF THE INVENTION

This invention relates to a time lag fuse. Electrical equipment normally contain a fuse to protect the internal components from any short circuiting current. In electrical equipment such as television sets and motors which are subject to enormous surge currents during start up, a specific protective circuit or fuse element is provided which is not melted down by the instantaneous surge current, and which will not be activated unless this current continues for longer than a time "lag".

Various conventional types of fuses with such time lag capabilities have been marketed. Although such fuses have utilized different types of melting elements, all are complex and accordingly do not meet the requirements dictated by mass production.

Therefore, it is the principal object of the present invention to provide a simple time lag fuse which is capable both of providing excellent time lag properties and of mass production.

SUMMARY OF THE INVENTION

The objects of this invention are achieved by providing a time lag fuse comprising a fuse barrel having two conductive caps, one at each end of the barrel. Within the barrel and connected to the caps is a fuse element, which is formed of twisted or bundled insulating fiber spirally bound by a melting element. The melting element may be made from a silver, copper or lead alloy.

DESCRIPTION OF THE PREFERRED EMBODIMENT

Figure 1:
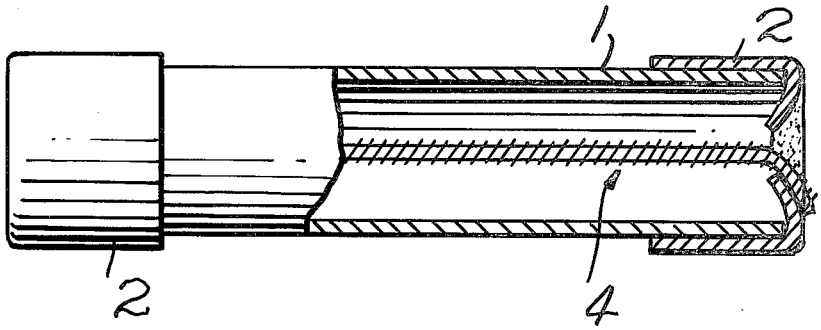
FIG. 1 shows a side elevational view of the time lag fuse which is partially cut away to better show the interior structure.
Figure 2:
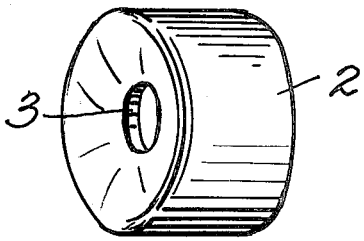
FIG. 2 is a perspective view of a conductive cap.
Figure 3:
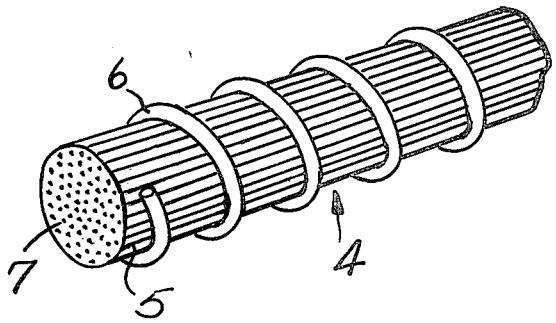
FIG. 3 is a perspective view of the fuse element.

With reference to the drawings of the preferred embodiment and more particularly to FIG. 1, a fuse barrel 1 has metal conductive caps 2 attached at both ends to fuse barrel 1 and a fuse element 4 within fuse barrel 1 and connected to conductive caps 2. As shown in FIG. 2, each conductive cap 2 has a hole 3 through which fuse element 4 extends. Fuse element 4 comprises a core cord 7 made up of numerous glass fibers 5, which act as insulating material. Glass fibers 5 are bundled as shown in FIG. 3 and thereafter spirally bound by melting element 6, preferably made of a silver alloy wire. Alternatively, melting element 6 may also be made of a single or twisted wire of a copper or lead alloy. The ends of melting element 6 are inserted into holes 3 in each cap 2 and soldered thereto to connect the conductive caps.

The time lag fuse of the present invention can contain a melting element with a length from several times to in excess of ten times that of the melting element length of any conventional time lag fuse. At the same time, the diameter of the melting element may, if desired, be increased a corresponding amount to that of the increased melting element length so as to extend the time of melting down. Thus, the melting element will not be melted down by surge current but will be melted down by a sustaining transient current indicating a short circuit.

Fuse element 4 comprised of core cord 7 which is made of glass fibers 5 and wire element 6 has remarkable tensile strength and softness. Accordingly, the time lag fuse of this invention may be manufactured very efficiently because numerous capped fuse barrels may be linked together with soldering fuse element 4 to each cap before cutting. This eliminates the amount of waste material from fuse element 4.

Likewise, the diameter of core cord 7 may be easily adjusted by increasing or decreasing the number of glass fibers 5, thereby permitting fuse element 4 to be easily manufactured in a diameter corresponding to that of hole 3 in caps 2. Thus, no special machining is necessary for obtaining the proper diameter, which serves to further lower production cost by permitting the use of any conventional caps. Moreover, due to the spiral structure of melting element 6 around core cord 7 of fuse element 4, melted solder is easily adapted to fit and firmly secure fuse element 4 upon solidifying.

Finally, the melting element 6 is spirally bound about core cord 7 in this invention in such a manner that melting element 6 is prevented from contacting fuse barrel 1 should it expand due to overheating. This prevents any change in the time lag property due to such a contacting of the melting element with the fuse barrel.

As noted above, this invention provides users with a time lag fuse having excellent time lag properties compared with any conventional linear type melting elements due to spirally binding melting element 6 around core cord 7. Moreover, this invention provides users with an extremely practical time lag fuse in terms of reliable melt down property with a very simple structure capable of mass production.

Many changes and modifications in the above described embodiment of the invention can be carried out without departing from the invention scope. Accordingly, the scope of the invention is to be determined only by the scope of the appended claims.

What is claimed is:

1. A time lag fuse comprising a fuse barrel having a conductive cap attached at each end of the fuse barrel and a fuse element within said fuse barrel and connected between said caps, wherein said fuse element is comprised of a core cord of insulating fibers spirally bound by a melting element.

2. A time fuse as in claim 1, wherein said melting element is chosen from the group consisting of a silver, copper or lead alloy.

3. A time lag fuse as in claim 2, wherein said insulating fibers are glass fibers.

4. A time lag fuse as in claims 1, 2 or 3 in which said fibers are bundled.

5. A time lag fuse as in claim 1, wherein said element is positioned so it does not contact said barrel even upon expansion due to overheating.

* * * * *